US008734037B2

(12) United States Patent
Kawaguchi et al.

(10) Patent No.: US 8,734,037 B2
(45) Date of Patent: May 27, 2014

(54) PRINTING APPARATUS

(75) Inventors: Koichiro Kawaguchi, Yokohama (JP); Toshiki Takeuchi, Yokohama (JP); Kengo Nieda, Kawasaki (JP); Tetsuhiro Nitta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 12/949,497

(22) Filed: Nov. 18, 2010

(65) Prior Publication Data

US 2011/0211896 A1 Sep. 1, 2011

(30) Foreign Application Priority Data

Feb. 26, 2010 (JP) ..... 2010-042339

(51) Int. Cl.
*B41J 15/00* (2006.01)
*B41J 2/165* (2006.01)
*B65H 85/00* (2006.01)

(52) U.S. Cl.
USPC ..... 400/578; 347/29; 347/104

(58) Field of Classification Search
USPC ..... 347/104; 400/578
See application file for complete search history.

(56) References Cited

U.S. PATENT DOCUMENTS 5,315,323 A * 5/1994 Ohshima et al. ..... 347/123
5,602,571 A * 2/1997 Suda et al. ..... 346/134
5,828,387 A * 10/1998 Wataya et al. ..... 347/14
6,168,333 B1 * 1/2001 Merz et al. ..... 400/634
2008/0252676 A1 * 10/2008 Yasutani et al. ..... 347/16
2009/0003854 A1 1/2009 Naoi
2009/0256896 A1 * 10/2009 Scarlata ..... 347/101
2011/0109710 A1 * 5/2011 Miyakoshi et al. ..... 347/104
2011/0298858 A1 * 12/2011 Kinoshita ..... 347/16

FOREIGN PATENT DOCUMENTS

JP 02-145358 A 6/1990
JP 11-249346 A 9/1999
JP 11249346 A * 9/1999 ..... G03G 15/00
JP 2000-255053 A 9/2000
JP 2000255053 A * 9/2000 ..... B41J 2/01
JP 2003-063072 A 3/2003
JP 2003063072 A * 3/2003 ..... B41J 3/42
JP 2009006655 A 1/2009
JP 2009078499 A * 4/2009 ..... B41J 2/175
JP 2009-298027 A 12/2009
JP 2009298027 A * 12/2009 ..... B41J 2/01

* cited by examiner

*Primary Examiner* — Judy Nguyen
*Assistant Examiner* — Nguyen Ha
(74) *Attorney, Agent, or Firm* — Canon USA, Inc., IP Division

(57) ABSTRACT

An apparatus may include a print head, multiple roller pairs to convey a sheet, a direct sensor, and a control unit. The print head prints on a conveyed sheet. The multiple roller pairs nip the sheet at an upstream side of the print head to convey the sheet, nip the sheet at a downstream side of the print head, and nip the sheet at an upstream side of a first roller pair to convey the sheet. The direct sensor measures a surface of the conveyed sheet at a measurement position between a nip position of the first roller pair and a nip position of a third roller pair to obtain information relating to a movement state of the sheet. The control unit controls to correct at least one of driving control of the print head and conveying control of the sheet, based on the information obtained by the direct sensor.

16 Claims, 9 Drawing Sheets

PRINTING APPARATUS

BACKGROUND OF THE INVENTION

1. Field of the Invention

The present invention relates to a printing apparatus which conveys sheets using a conveying roller, and performs printing.

2. Description of the Related Art

Japanese Patent Laid-Open No. 2009-6655 discloses a printing apparatus which directly measures speed at a sheet surface with a speed sensor, and controls ink discharge timing of a print head. FIG. 10 is a diagram illustrating in a simplified manner the printing apparatus disclosed in FIG. 25 of Japanese Patent Laid-Open No. 2009-6655. A sheet 500, wound in the form of a roll, is conveyed by an upstream side conveying roller pair 501 and a downstream side conveying roller pair 502, and printing is performed thereupon by a print head 503. A speed sensor 504 (laser Doppler sensor) for directly measuring the moving speed of the sheet is positioned between the upstream side conveying roller pair 501 and the print head 503. The driving control timing of the print head 503 is corrected in accordance with the conveying speed measured at the speed sensor 504, thereby realizing high-quality printing.

SUMMARY OF THE INVENTION

With the device in Japanese Patent Laid-Open No. 2009-6655, the speed sensor is positioned between the upstream side conveying rollers and the print head. A speed sensor (laser Doppler sensor) requires a great placement space, so the distance between the conveying rollers and the print head increases accordingly. Accordingly, there is a higher possibility of the leading edge portion of the sheet moving upwards between the conveying rollers and the print head, and the leading edge of the sheet coming into contact with the nozzles of the print head that are situated most upstream.

In order to suppress this, the distance between the speed sensor and print head needs to be reduced as much as possible. However, the closer the speed sensor and print head are, the greater the following problems are manifested.

(1) The probability that there is not enough time to calculate speed and control the ink discharge timing within the time it takes for the sheet to travel from the measurement position of the speed sensor to the nozzles of the print head that are situated most upstream is greater. This problem becomes greater as the conveying speed of the sheet becomes faster, so increasing the printing speed becomes difficult.

(2) Making the distance between the printing region to be printed on by the print head and the measurement position of the speed sensor to be smaller increases the probability that cockling (local undulation of the sheet) occurring when the sheet absorbs ink immediately after printing will affect the measurement position. Undulation of the sheet at the measurement position can lead to measurement error.

(3) If the print head and speed sensor are in close proximity and there is no shielding member therebetween, ink mist (fine ink droplets) which are generated and scatter at the time of discharging ink from the print head readily adhere to the speed sensor. The speed sensor (laser Doppler sensor) has a light emitting unit and photoreceptor, and ink adhering to the light emitting unit or photoreceptor will deteriorate the detection signal level, impeding stable measurement.

The present invention has been made in light of the above problems. The present invention provides for a printing apparatus in which high-speed conveying of sheets and precise measurement of the speed sensor are both realized at a high level, i.e., a printing apparatus in which printing throughput and printing quality are realized at a high level. The present invention also provides for a printing apparatus in which printing quality can be maintained even when running for long periods of time.

An apparatus is provided including: a print head configured to print on a conveyed sheet; a first roller pair configured to nip the sheet at an upstream side of the print head to convey the sheet; a second roller pair configured to nip the sheet at a downstream side of the print head to convey the sheet; a third roller pair configured to nip the sheet at an upstream side of the first roller pair to convey the sheet; a direct sensor configured to measure a surface of the conveyed sheet at a measurement position between a nip position of the first roller pair and a nip position of the third roller pair so as to obtain information relating to a movement state of the sheet; and a control unit configured to control to correct at least one of driving control of the print head and conveying control of the sheet, based on the information obtained by the direct sensor.

According to the above configuration, a printing apparatus in which high-speed conveying of sheets and precise measurement of the speed sensor are both realized at a high level, is realized.

Further features of the present invention will become apparent from the following description of exemplary embodiments with reference to the attached drawings.

DESCRIPTION OF THE EMBODIMENTS

First Embodiment

Hereafter, embodiments of a printing apparatus using the inkjet method will be described. The printing apparatus of the present embodiment is a high-speed line printer which can handle both of simplex printing and duplex printing using a long continuous sheet (long continuous sheet longer than the length of repetition printing units (also called one page or unit image) in the conveying direction). For example, this printing apparatus is adapted to a field for printing a great number of sheets in a print lab or the like. Note that, with the present Specification, even when multiple small images, letters, or blanks are mixed in a one printing unit (one page) region, all included in this region are referred to as one unit image. That is to say, a unit image means one printing unit (one page) in the event of successively printing multiple pages on a continuous sheet. The length of a unit image differs according to an image size to be printed. For example, with a photo of L size, the length in the sheet conveying direction is 135 mm, and with A4 size, the length in the sheet conveying direction is 297 mm.

The present invention may widely be applied to a printing apparatus such as a printer, a multi-function printer, a copying machine, a facsimile apparatus, a manufacturing device of various types of device, and so forth. The print processing is not restricted to any method, and may be the inkjet method, electrophotography method, thermal transfer method, dot-impact method, liquid development method, or the like. Also, the present invention is not restricted to print processing, and may be applied to a sheet processing device which subjects a continuous sheet to various types of processing (recording, processing, coating, irradiation, scanning, inspection, and so forth).

Figure 1:
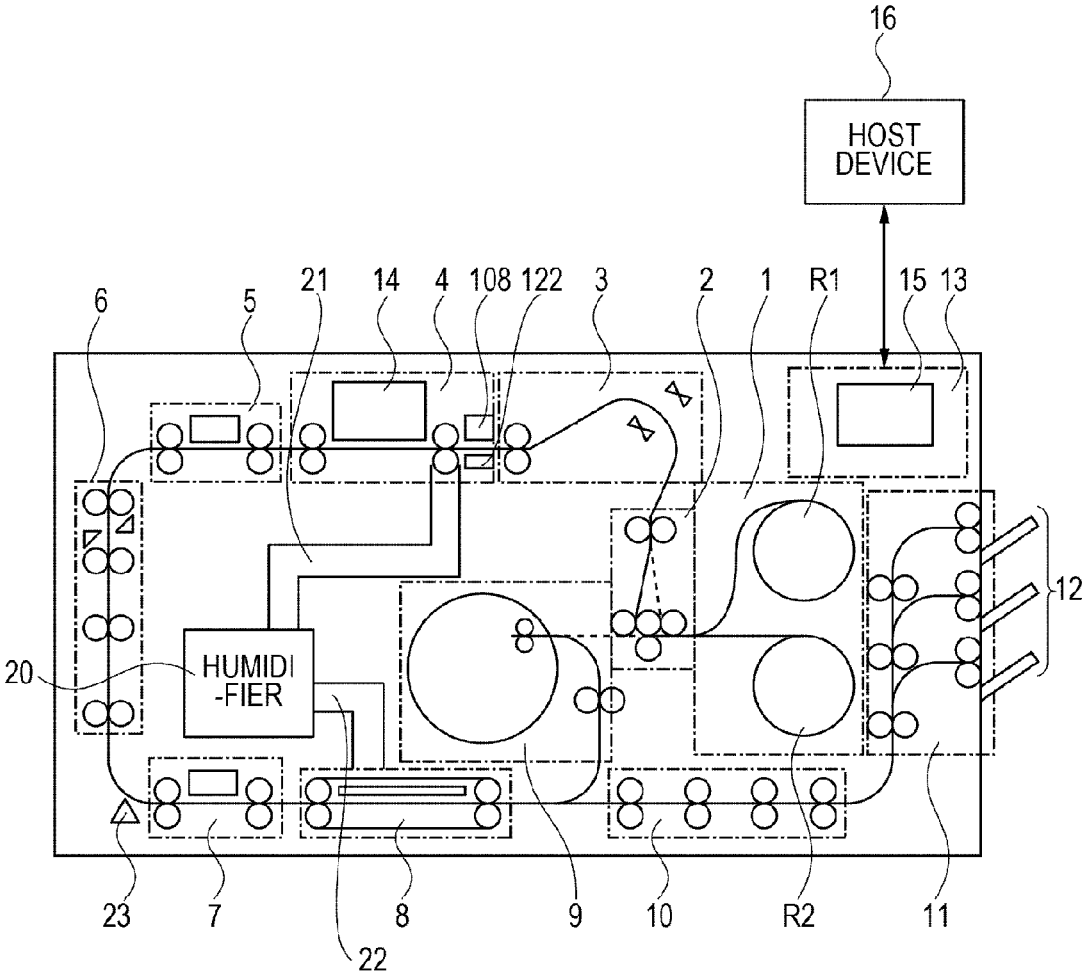
FIG. 1 is a schematic diagram illustrating the inner configuration of a printing apparatus.

FIG. 1 is a schematic view illustrating the internal configuration of the printing apparatus. The printing apparatus according to the present embodiment is capable of using a sheet wound in a rolled state to perform duplex printing on a first surface of the sheet and a second surface on the back face side of the first surface. The printing apparatus principally includes each unit of a sheet feeding unit 1, a decurling unit 2, a skew correcting unit 3, a printing unit 4, an inspection unit 5, a cutter unit 6, an information recording unit 7, a drying unit 8, a reverse unit 9, a discharge conveying unit 10, a sorter unit 11, a discharge unit 12, a humidifier 20, and a control unit 13. The sheet is conveyed by a conveying mechanism made up of a roller pair and a belt and so forth along a sheet conveying route indicated with a solid line in the drawing, and is processed at each unit. Note that with an arbitrary position of the sheet conveying route, the side near the sheet feeding unit 1 is refereed to as "upstream", and the opposite side thereof is referred to as "downstream".

The sheet feeding unit 1 is a unit for holding and feeding a continuous sheet wound in a rolled state. The sheet feeding unit 1 is capable of housing two rolls R1 and R2, and has a configuration for alternatively paying out sheets to be fed. Note that the number of rolls to be housed is not restricted to two, and one or three or more may be housed. Also, the sheets are not restricted to being wound on rolls as long as they are continuous. For example, an arrangement may be made wherein a continuous sheet is provided with perforated lines every unit length, and folded back and forth to be layered and stacked in the sheet feeding unit 1.

The decurling unit 2 is a unit for reducing curling (warping) of the sheet fed from the sheet feeding unit 1. With the decurling unit 2, curling is reduced by decurling force being influenced by passing through the sheet in a bent manner so as to provide warping in the opposite direction using two pinch rollers as to one driving roller.

The skew correcting unit 3 is a unit for correcting skewing of the sheet having passed through the decurling unit 2 (angle as to the true direction of travel). The inclination of the sheet is corrected by pressing a sheet edge portion on the side serving as a reference against a guide member.

The printing unit 4 is a sheet processing unit for subjecting a sheet to be conveyed to print processing by a print head 14 from above to form an image. That is to say, the printing unit 4 is a processing unit for subjecting the sheet to predetermined processing. The printing unit 4 also includes multiple conveying rollers to convey a sheet. The print head 14 includes a line-type print head where a nozzle train of the inkjet method is formed in a range covering the maximum width of a sheet to be used. With the print head 14, multiple print heads are arrayed in parallel along the conveying direction. With the present example, the print head 14 includes seven print heads corresponding to seven colors of C (cyan), M (magenta), Y (yellow), LC (light cyan), LM (light magenta), G (gray), and K (black). Note that the number of colors, and the number of print heads are not restricted to seven. As for the inkjet method, there may be employed a method using a heater element, a method using a piezoelectric element, a method using an electrostatic device, a method using an MEMS element, or the like. The ink of each color is supplied to the print head 14 via the corresponding ink tube from an ink tank.

At the printing unit 4, a director sensor 108 is provided upstream of the print head 14 to obtain information relating to the movement state of the sheet (movement speed and movement amount) by directly measuring the sheet face at a predetermined measurement position. Also provided is a mark reader 122 for reading marks formed on the sheet by the print head 14 from the reverse side. The direct sensor 108 and mark reader 122 will be described in detail later.

The inspection unit 5 is a unit for optically scanning a test pattern or image printed on a sheet at the printing unit 4 by a scanner to determine whether the image has correctly been printed by inspecting the states of the nozzles of the print head, sheet conveying state, image position, and so forth. The scanner includes a CCD image sensor or CMOS image sensor.

The cutter unit 6 is a unit including a mechanical cutter 20 for cutting a sheet after printing into a predetermined length. The cutter unit 6 also includes multiple conveying rollers for feeding out the sheet to the next process.

The information recording unit 7 is a unit for recording print information (unique information) in a non-print region of the cut sheet, such as the serial number or date or the like of printing. Recording is performed by printing characters or code by the inkjet method or thermal transfer method or the like. A sensor 23 for detecting the leading edge of the cut sheet is provided to the upstream side of the information recording unit 7 and the downstream side of the cutter unit 6. That is to say, timing for recording information at the information recording unit 7 is controlled based on the detection timing of the sensor 23 which detects the edge portion of a sheet between the cutter unit 6 and the recorded position by the information recording unit 7.

The drying unit 8 is a unit for heating the sheet printed by the printing unit 4 to dry the applied ink in a short period of time. The sheet to be passed through is applied with heated air from at least the lower face side to dry the ink applied face within the drying unit 8. Note that the drying method is not restricted to the method for applying heated air, and may be a method for irradiating electromagnetic waves (such as an ultraviolet ray, infrared ray, or the like) on the sheet front face.

The above sheet conveying route from the sheet feeding unit 1 to the drying unit 8 will be referred to as a first route. The first route has a shape which performs a U-turn between the printing unit 4 and the drying unit 8, and the cutter unit 6 is positioned in the middle of the U-turn shape.

The reverse unit 9 is a unit for temporarily winding the continuous sheet of which the front face printing has been completed thereupon to reverse both sides at the time of performing duplex printing. The reverse unit 9 is provided in the middle of a route (loop path) (referred to as "second route") from the drying unit 8 to the printing unit 4 via the decurling unit 2 for feeding the sheet passed through the dying unit 8 to the printing unit 4 again. The reverse unit 9 includes a winding rotary member (drum) which rotates for winding the sheet thereupon. The continuous sheet of which the printing of front face has been completed has not been cut is temporarily wound around the winding rotary member. At the time of winding being completed, the winding rotary member rotates in reverse, the sheet wound thereupon is fed out in the reverse order at the time of winding around the decurling unit 2, and is fed to the printing unit 4. Both sides of this sheet have been reversed, so the back face can be printed at the printing unit 4. More specific operation of duplex printing will be described later.

The discharge conveying unit 10 is a unit for conveying the sheet cut at the cutter unit 6 and dried at the drying unit 8 to transfer the sheet to the sorter unit 11. The discharge conveying unit 10 is provided to a route different from the second route where the reverse unit 9 is provided (referred to as "third route"). In order to selectively guide the sheet conveyed in the first route into any one of the second route and third route, a route switching mechanism having a movable flapper is provided to a branching position of the routes (hereafter referred to as "discharge branching position").

The sorter unit 11 and the discharge unit 12 are provided to the side portion of the sheet feeding unit 1 and also the tail end of the third route. The sorter unit 11 is a unit for classifying the printed sheet for each group as appropriate. The classified sheet is discharged to the discharge unit 12 made up of multiple trays. In this way, the third route has a layout where the sheet is passed through the lower side of the sheet feeding unit 1 and is discharged to the opposite side of the printing unit 4 and the drying unit 8 sandwiching the sheet feeding unit 1.

The humidifier 20 is a unit for generating moist gas (air) to be supplied between the print head 14 of the printing unit 4 and the sheet. Thus, drying of the ink at the nozzles of the print head 14 is suppressed. The humidification method of the humidifier 20 may be aeration, water atomization, vaporization, or the like. Aeration includes, besides the impeller method used in the present embodiment, moisture permeation film methods, instillation permeation methods, capillary tube methods, and so forth. Water atomization methods include ultrasonic methods, centrifugal methods, high-pressure spray methods, two-fluid atomization methods, and so forth. Vaporization methods include steam tube methods, electro-thermal methods, electrode methods, and so forth. The humidifier 20 and printing unit 4 are connected by a first duct 21, and further the humidifier 20 and drying unit 8 are connected by a second duct 22. The drying unit 8 generates hot gas with a high humidity content at the time of drying the sheet. This gas is taken into the humidifier 20 via the second duct 22, and used as auxiliary energy for generating the humidifying gas at the humidifier 20. The humidifying gas generated at the humidifier 20 is then led to the printing unit via the first duct 21. The humidifying gas led into the printing unit flow through the gap between the print head and the sheet, from upstream toward downstream, as described later.

The control unit 13 is a unit which manages control of each unit of the whole printing apparatus. The control unit 13 includes a CPU, a storage device, a controller including various types of control unit, an external interface, and an operation unit 15 by which a user performs input/output. The operation of the printing apparatus is controlled based on the command from a host device 16 such as a host computer to be connected to the controller directly or via the external interface.

Figure 2:
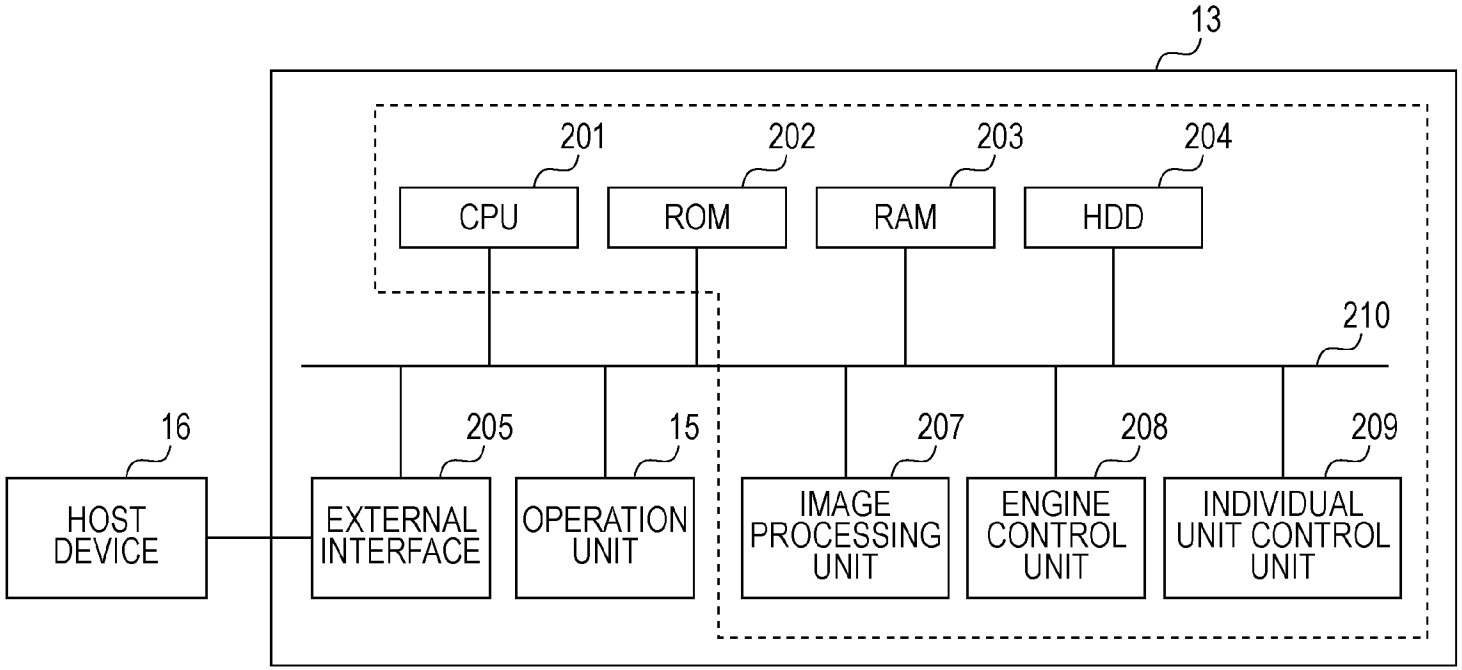
FIG. 2 is a block diagram of a control unit.

FIG. 2 is a block diagram illustrating the concept of the control unit 13. The controller included in the control unit 13 (range surrounded with a dashed line) is configured of a CPU 201, ROM 202, RAM 203, an HDD 204, an image processing unit 207, an engine control unit 208, and an individual unit control unit 209. The CPU 201 (central processing unit) centrally controls the operation of each unit of the printing apparatus. The ROM 202 stores a program to be executed by the CPU 201, and fixed data to be used for various types of operation of the printing apparatus. The RAM 203 is used as the work area of the CPU 201, or used as a temporarily storage region of various types of reception data, or used for storing various types of setting data. The HDD 204 (hard disk) can store or read out a program to be executed by the CPU 201, print data, and setting information used for various types of operation of the printing apparatus. The operation unit 15 is an input/output interface with the user, and includes an input unit such as a hard key or touch panel, and an output unit such as a display for presenting information, an audio generator, or the like. For example, a touch panel display is used, displaying for the user the operating statues of the device, the printing state, maintenance information (remaining amount of ink, remaining sheets, maintenance status, etc.) and so forth. The user can input various types of information from the touch panel.

A dedicated processing unit is provided regarding a unit which requires high-speed data processing. The image processing unit 207 performs the image processing of print data to be handled at the printing apparatus. The image processing unit 207 converts the color space of the input image data (e.g., YCbCr) into standard RGB color space (e.g., sRGB). Also, the image data is subjected to various types of image processing such as resolution conversion, image analysis, image correction, or the like as appropriate. The print data obtained by these image processes is stored in the RAM 203 or HDD 204. The engine control unit 208 performs driving control of the print head 14 of the printing unit 4 according to the print data based on the control command received from the CPU 201 or the like. The engine control unit 208 further performs control of the conveying mechanism of each unit within the printing apparatus. The individual unit control unit 209 is a sub controller for individually controlling each unit of the sheet feeding unit 1, decurling unit 2, skew correcting unit 3, inspection unit 5, cutter unit 6, information recording unit 7, drying unit 8, reverse unit 9, discharge conveying unit 10, sorter unit 11, discharge unit 12, and dehumidifier 20. The operation of each unit is controlled by the individual unit control unit 209 based on the command by the CPU 201. The external interface 205 is an interface for connecting the controller to the host device 16, and is a local interface or network interface. The above components are connected by a system bus 210.

The host device 16 is a device serving as the supply source of image data for causing the printing apparatus to perform printing. The host device 16 may be a general-purpose or dedicated computer, or may be dedicated image equipment such as an image capture having an image reader unit, a digital camera, photo storage, or the like. In the event that the host device 16 is a computer, OS, application software for generating image data, and a printer driver for printing apparatus are installed into a storage device included in the computer. Note that it is not essential that all of the above processes are realized by software, so part or all may be realized by hardware.

Next, basic operation at the time of printing will be described. With printing, the operation differs depending on the simplex print mode or the duplex print mode, so each will be described.

Figure 3:
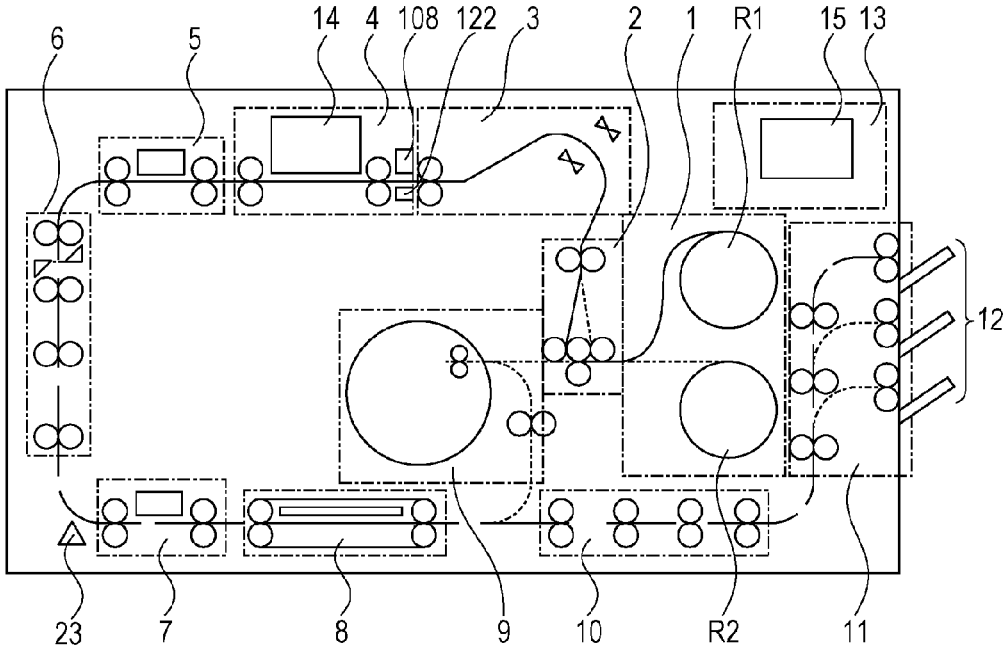
FIG. 3 is a diagram for describing operations in a simplex printing mode.

FIG. 3 is a diagram for describing the operation in the simplex print mode. With the sheet fed from the sheet feeding unit 1, and processed at each of the decurling unit 2 and skew correcting unit 3, printing of the front face (first surface) is performed at the printing unit 4. The image (unit image) of a predetermined unit length in the conveying direction is sequentially printed to array the multiple images as to the long continuous sheet. The printed sheet is cut for each unit image at the cutter unit 6 via the inspection unit 5. With the cut sheets, print information is recorded on the back faces of the sheets by the information recording unit 7 as appropriate. The cut sheets are conveyed to the drying unit 8 one sheet at a time, and are dried. Subsequently, the cut sheets are sequentially discharged to the discharge unit 12 of the sorter unit 11 via the discharge conveying unit 10, and are loaded. On the other hand, the sheets left behind to the printing unit 4 side at the time of cutting of the last unit image is fed back to the sheet feeding unit 1, and the sheets are wound around the rolls R1 and R2. Thus, with simplex printing, the sheet is processed passing through the first route and third route, and does not pass through the second route.

Figure 4:
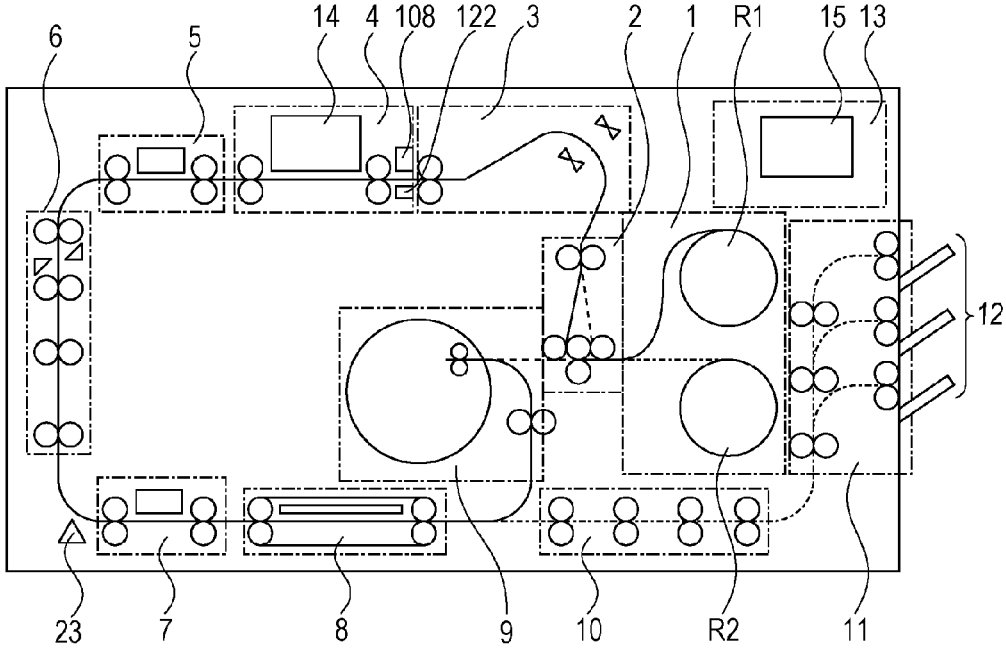
FIG. 4 is a diagram for describing operations in a duplex printing mode.

FIG. 4 is a diagram for describing the operation in the duplex print mode. With duplex printing, back face (second surface) print sequence is executed following the front face (first surface) print sequence. With the first front face print sequence, the operation at each unit from the sheet feeding unit 1 to the inspection unit 5 is the same as the operation of the above simplex printing. Cutting operation is not performed at the cutter unit 6, and the sheet is conveyed to the drying unit 8 still in the continuous sheet form. After ink drying of the front face at the drying unit 8, the sheet is guided not to the route on the discharge conveying unit 10 (third route) but to the route on the reverse unit 9 side (second route). With the second route, the sheet is wound around the winding rotary member of the reverse unit 9 which rotates in the forward direction (counter clockwise direction in the drawing). After the scheduled front face printing is all completed at the printing unit 4, the trailing edge of the print region of the continuous sheet is cut at the cutter unit 6. The continuous sheet on the conveying direction downstream side (printed side) is all wound around up to the sheet trailing edge (cut position) at the reverse unit 9 through the drying unit 8 with the cut position as a reference. On the other hand, at the same time as the winding at the reverse unit 9, the continuous sheet left behind on the conveying direction upstream side (printing unit 4 side) of the cut position is wound back to the sheet feeding unit 1 so that the sheet leading edge (cut position) is not left behind at the decurling unit 2, and the sheet is wound around the rolls R1 and R2. Collision with the sheet to be fed again in the following back face print sequence is avoided according to this winding back (back-feeding).

After the above front face print sequence, the front print sequence is switched to the back face print sequence. The winding rotary member of the reverse unit 9 rotates in the opposite direction (clockwise direction in the drawing) of the direction at the time of being wound thereupon. The edge portion of the sheet wound around (the sheet trailing edge at the time of being wound thereupon becomes the sheet leading edge at the time of being fed back) is fed to the decurling unit 2 along the route indicated with a dashed line in the drawing. Correction of curling applied by the winding rotary member is performed at the decurling unit 2. That is to say, the decurling unit 2 is a common unit which serves decurling in either route, provided between the sheet feeding unit 1 and the printing unit 4 in the first route, and provided between the reverse unit 9 and the printing unit 4 in the second route. The sheet of which both sides are inverted is fed to the printing unit 4 via the skew correcting unit 3, where printing on the back face of the sheet is performed. The printed sheet is fed to the cutter unit 6 via the inspection unit 5, and is cut at the cutter unit 6 for each predetermined unit length. With the cut sheet, both sides are printed, so recording at the information recording unit 7 is not performed. The cut sheet is conveyed to the drying unit 8 one sheet at a time, and is sequentially discharged and loaded in the discharge unit 12 of the sorter unit 11 via the discharge conveying unit 10. In this way, with duplex printing, the sheet is processing passing through the first route, second route, first route, and third route in this order.

Figure 5:
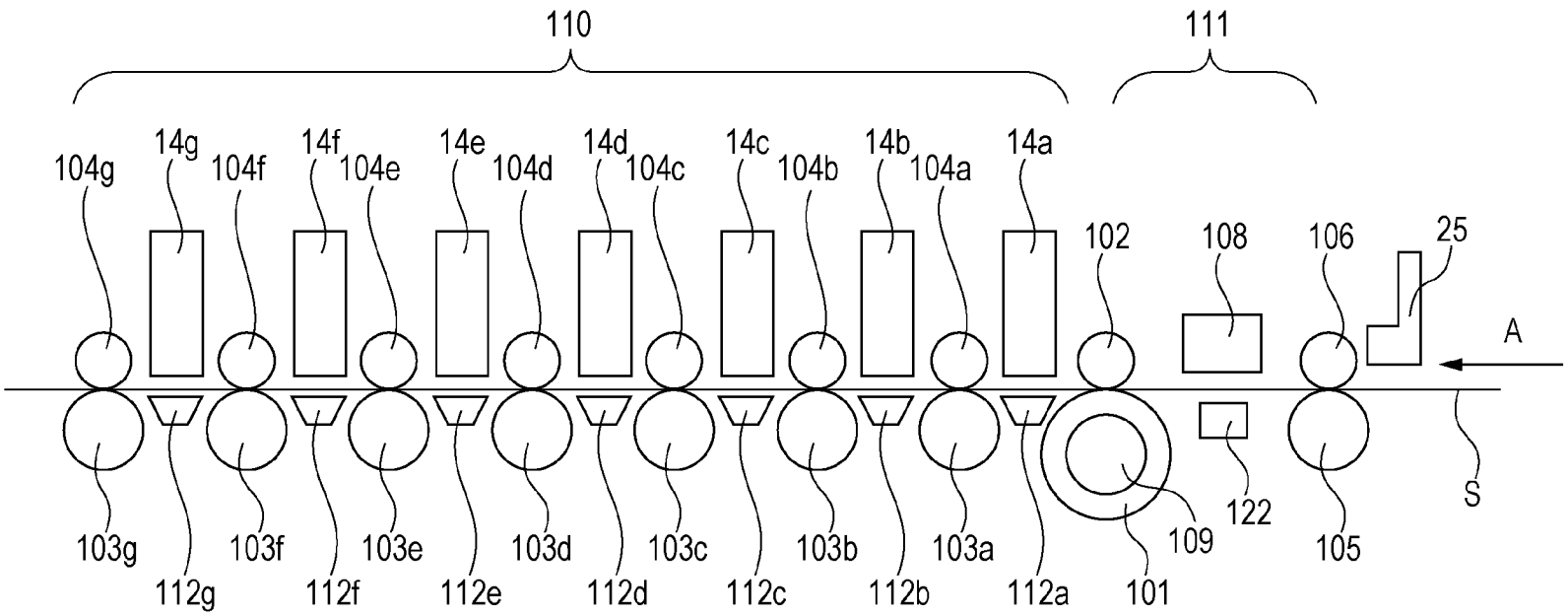
FIG. 5 is a detailed configuration diagram of a printing unit.

Next, the printing unit 4 of the printer with the above-described configuration will be described in further detail. FIG. 5 is a configuration diagram of the printing unit 4. With the printing unit 4, a sheet S is conveyed by a first roller pair, second roller pairs, and a third roller pair, in the direction A in the drawing. The first roller pair is a roller pair made up of a convoying roller 101 having driving force and a pinch roller 102 which is driven so as to rotate. The second roller pairs indicate roller pairs (seven sets) made up of multiple convoying rollers 103*a* through 103*g* having driving force and pinch rollers 104*a* through 104*g* which are driven so as to rotate. The third roller pair is a roller pair made up of a convoying roller 105 having driving force and a pinch roller 106 which is driven so as to rotate. The conveying roller 101 is provided with a rotary encoder 109 for detecting the rotational state of the roller.

Seven line print heads 14*a* through 14*g* are arrayed in a print region 110 downstream of the first conveying roller pair, arrayed in the conveying direction. The line print heads 14*a* through 14*g* and the pinch rollers 104*a* through 104*g* are arrayed alternately. Platens 112*a* through 112*g* are provided at positions facing the line print heads 14*a* through 14*g*, respectively, so as to support the sheet S. The sheet S is nipped by roller pairs upstream and down stream and supported by the platens at the positions facing the line print heads 14*a* through 14*g*, so the behavior of sheet conveyance is stable. At the time of the sheet first being led in, in particular, the sheet leading edge passes through multiple nip positions one after another, so stable sheet introduction with undulation of the leading of the edge of the sheet having been suppressed is performed.

The direct sensor 108 is a non-contact optical sensor which directly obtains information relating to the moving state of the sheet (movement speed or movement distance) from the sheet, by directly measuring the sheet face. The measurement position 111 is between the nip position of the first roller pair and the nip position of the third roller pair. The direct sensor obtains information relating to the moving state of the sheet by measuring the sheet face at the measuring position 111. With the present example, the direct sensor 108 is a laser Doppler sensor. A laser Doppler sensor is a speed sensor which casts a laser beam on a moving face and measures movement speed or movement distance from Doppler shift. The measurement principle of a more detailed configuration of a laser Doppler sensor is described in the above-described Japanese Patent Laid-Open No. 2009-6655 and other literature and is widely known, so description here will be omitted.

At the measurement position 111, a mark reader 122 is provided at a position across the sheet S from the direct sensor 108. The mark reader 122 reads marks formed on the first surface of the sheet S, at the measurement position of the sheet S by the direct sensor 108, from the back side of the sheet S. The mark reader 122 has a light source (e.g., white LED) for illuminating the sheet face, and a photoreceptor such as a photodiode or image sensor or the like, for detecting light reflected at the face of the sheet in RGB components. The marks can be read according to change in the signal level at the photoreceptor of image analysis of imaged data. At the time of back face printing in the above-described duplex printing mode, the mark reader 122 can read marks indicating image positions formed on the first surface of the sheet S, so as to be used for positioning the rear face image.

The direct sensor 108 can in principle measure the movement state of the sheet S from either the front face (first surface) or back face (second surface) of the sheet S. On the other hand, the mark reader 122 needs to read the sheet from the back face side. The mark reader 122 has been placed on the back face side of the sheet S, so the opposing direct sensor 108 is placed on the front face side of the sheet S. Accordingly, the distance between the first roller pair and third roller pair in the sheet conveying direction A does not have to be great, but the direct sensor 108 may be placed on the back face side of the sheet S. In this case, placing the direct sensor 108 and mark reader 122 in parallel in the width direction orthogonal to the conveyance direction A (the near/far direction in FIG. 5) does away with the need to have a great distance between the first roller pair and third roller pair. Placing both of the direct sensor 108 and mark reader 122 on the back face side shields these from ink mist generated at the print head 14 when printing, with the sheet S, which is advantageous in that deterioration in detecting capabilities due to adherence of ink mist to the sensors can be suppressed.

At the printing unit 4, a discharge opening 25 is provided further upstream from the third conveying roller pair. The discharge opening 25 is an inlet for the humidifying gas generated at the humidifier 20 introduced into the printing unit 4 through the first duct 21. The humidifying gas blown out from the discharge opening 25 flows between the print head 14 and sheet S, from upstream to downstream, thereby suppressing drying out of ink at the nozzles of the print head 14.

Figure 6:
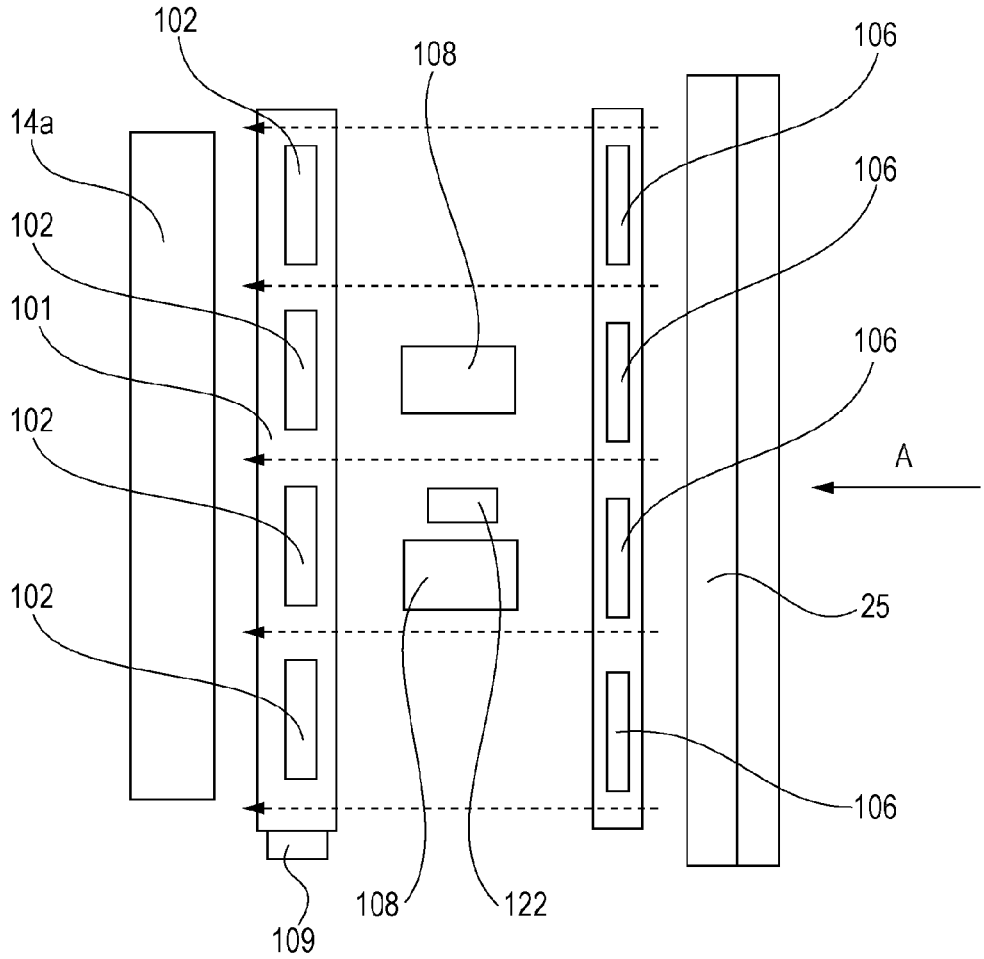
FIG. 6 is a plan view illustrating the positional relation around a direct sensor.

FIG. 6 is a plan view illustrating the positional relation between the direct sensors 108, mark reader 122, first roller pair, discharge opening 25, and print head 14*a* which is farthest upstream. Two direct sensors 108 are provided in the width direction. When viewed from above, the mark reader 122 is situated between the two direct sensors 108. Providing two direct sensors 108 in the width direction of the sheet allows the behavior of the sheet to be accurately measured even in the event that the conveyance speed of the sheet S being conveyed is not the same at the two measurement positions (i.e., in the event that there is skewing). Further, even in the event that one of the direct sensors 108 becomes incapable of measurement, the other can serve as a backup, thereby improving reliability. Note that the number of direct sensors 108 may be three or more, or may be just one.

The pinch roller 102 coming into contact with the conveying roller 101, and the pinch roller 106 coming into contact with the conveying roller 105, are both divided into multiple small roller portions in the width direction of the sheet. Accordingly, as indicated by the arrow in FIG. 6, the humidifying gas introduced from the discharge opening 25 passes between and around the adjacent small roller portions, and reaches the gap between the print head 14*a* which is farthest upstream and the sheet S. The humidifying gas further flows through the gap between all of the print heads 14*a* through 14*g* and the sheet S, from upstream to downstream. The pinch rollers 104*a* through 104*g* are also divided into multiple small roller portions in the width direction of the sheet, such that the humidifying gas passes between and around the adjacent small roller portions.

Returning to FIG. 5, the sheet S fed from the sheet feeding unit 1 is conveyed being nipped at predetermined not positions, in the order of the third roller pair, first roller pair, and second roller pairs. The conveyance route between the first roller pair and third roller pair is a straight line. Note that the term "straight line" as used here is not strictly limited to a straight line, and includes arrangements where the conveying route is generally a straight line.

The conveying force with which each of the rollers convey the sheet is set so as to satisfy the following Expression 1.

first roller pair>second roller pair>third roller pair (Expression 1)

The conveying force is determined by the nipping force of the pinch rollers. The reason is that the greater the nipping force is, the more difficult it is for slipping to occur between the sheet and roller face. The nipping force is determined by the force of springs pressing the pinch rollers against the conveying rollers. With the present example, the spring pressure for the pinch roller 102 of the first roller pair is set to 20 kgf, the spring pressure for the pinch rollers 104*a* through 104*g* of the second roller pairs is set to 4 kgf for the total of the seven rollers, and the spring pressure for the pinch roller 106 of the third roller pair is set to 1 kgf. Due to such a relation, the dominance of the first roller pair is the greatest, so centering on improving the precision of conveyance control of the first roller pair out of all of the rollers will improve overall sheet conveying precision.

The conveying speed of each of the roller pairs (circumferential speed of the conveying rollers) is set so as to satisfy the following Expression 2.

second roller pair>first roller pair>third roller pair (Expression 2)

A torque limiter is provided on the same shaft as the conveying roller 105 of the third roller pair. A torque limiter is arranged to slip when rotational torque of a predetermined value or greater is applied thereto, thereby limiting transmission of force. The conveying speed of the conveying roller 105 is slightly smaller than the conveying speed of the conveying roller 101, so when conveying, the torque limiter of the conveying roller 105 acts such that the conveying roller 105 slightly decelerates. Accordingly, even in the even that there is slight eccentricity or irregularity in the roller shape of the conveying roller 105, the overall sheet conveying precision is hardly affected at all.

Due to such a relation of conveying force (Expression 1) and conveying speed (Expression 2), there is hardly any slippage at all at the nip position of the first roller pair which is the main conveying mechanism (i.e., between the conveying roller 101 and the sheet S). Slippage does occur at the nip positions of the second roller pairs (between the conveying rollers 103*a* through 103*g* and the sheet S), due to difference in speed. At the nip position of the third roller pair (between the conveying roller 105 and sheet S), slippage occurs due to speed difference, and further, the torque limiter acts at the conveying roller 105. Due to satisfying the above relation, the first roller pair determines the overall conveying speed. Also, weak tension is applied to the sheet S at each of the roller pairs, thereby suppressing local undulation of the sheet. Accordingly, in the print region 110, the distance between each print head 14 and the sheet S is maintained constant, and high printing precision is maintained. Also, the distance between the direct sensors 108 and the sheet is maintained constant at the measurement position 111 of the direct sensors 108 as well, so high measurement precision is maintained.

The controller of the control unit 13 controls the ink discharging timing (driving control riming) of each of the nozzles of the print heads 14*a* through 14*g*, based on the information relating to the sheet conveying state obtained by measuring with the direct sensors 108. The ink discharge timing is basically controlled based on the measurement values of the rotary encoder 109 (detection pulse count) provided to the conveying roller 101. However, in the event that the conveying roller 101 has slight eccentricity, or there is slight slippage between the conveying roller 101 and the sheet S, there will be error between the measured value of the rotary encoder 109 and the conveying speed (or conveying distance) of the sheet S. The direct sensors 108 directly measure the movement state of the sheet, and accordingly can obtain information regarding the conveying speed (or conveying distance) of the sheet S with higher precision than the rotary encoder 109. Obtaining the difference between the measurement value of the direct sensors 108 and the measurement value of the rotary encoder 109 yields error information. Based on this error information, the measurement value of the rotary encoder 109 is corrected, and used to control the ink discharge timing of the print heads 14*a* through 14*g* (timing to provide driving pulses to each nozzle). Thus, slight conveying error at the conveying roller 101 is corrected at with regard to the timing for printing with the print heads, thereby realizing high image quality in printing.

Note that an arrangement may be made wherein, along with timing correction for printing, or without timing correction for printing, the results of measurement at the direct sensors 108 are fed back to the sheet conveying control and used for controlling correction of conveying error. The sheet conveying control is performed to change the conveying speed of at least the first roller pair, so as to correct conveying error. Preferably, the conveying speed of the second roller pairs and the third conveying pair also is changed. That is to say, the controller of the control unit 13 effects control so as to correct at least one of print head driving control and sheet conveying control. With either method, high printing image quality is realized.

Also, driving mechanism may be made wherein the pinch roller 106 of the third roller pair can vertically move toward and away from the conveying roller 105, so as to switch between a nipped state and a nip disengaged state. Maintaining the nipped state at the third roller pair when measuring with the direct sensor 108, and disengaging the nip when unnecessary, reduces the effects that the third roller pair has on conveying precision that the time of disengaging the nip.

Also, non-contact optical sensors other than laser Doppler sensors may be used for the direct sensors 108. For example, there are direct sensors of types using image sensors (CCD image sensors or CMOS image sensors). Direct sensors of this type image the moving sheet face at different timings in a time sequence using a fixed image sensor, so as to obtain data of multiple images. The image data is compared with a technique such as pattern matching or the like, thereby obtaining the moving state (moving distance and moving speed) of the sheet.

Figure 7:
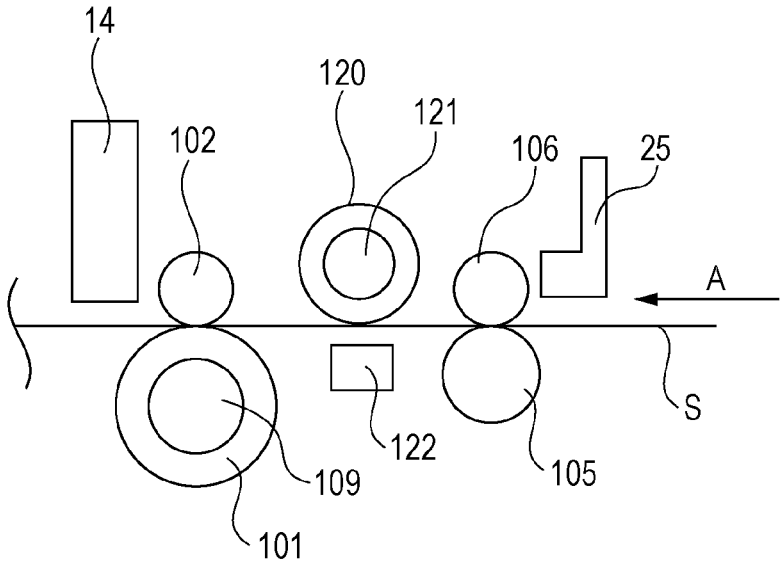
FIG. 7 is a diagram illustrating another form of a direct sensor.

As for another arrangement of the direct sensors 108, contact type direct sensors which have a sensor face physically in contact with the face of the sheet S may be used. FIG. 7 illustrates the configuration of one example thereof. This is a direct sensor configured of a reading roller 120 which is in contact with the sheet face and rotates being driven along with the movement of the sheet S, and a rotary encoder 121 which detects the rotations of the reading roller 120.

Figure 8:
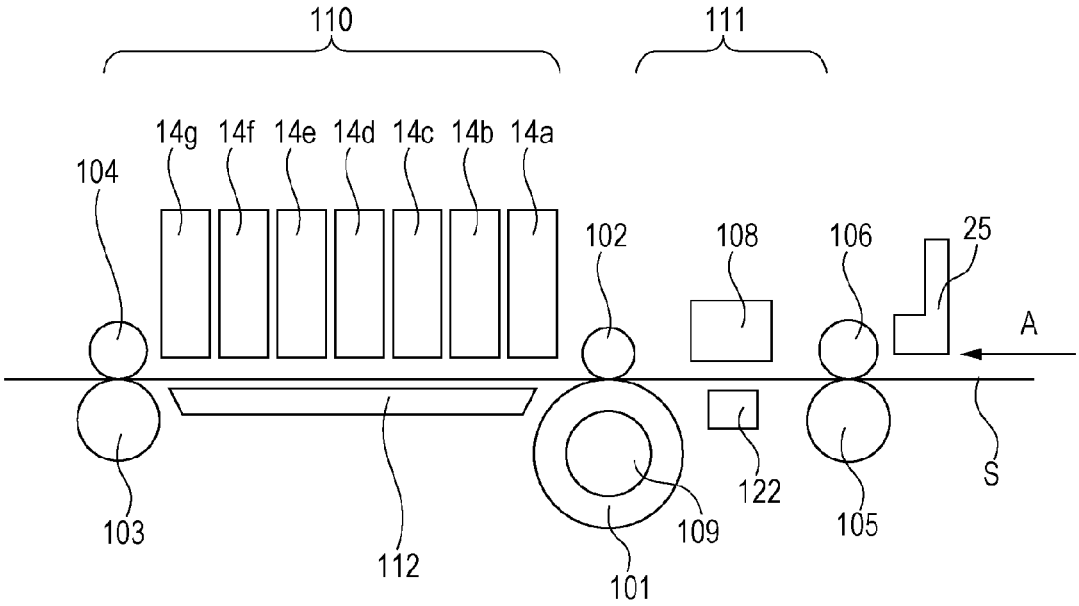
FIG. 8 is a diagram illustrating another form of a printing unit.

With the embodiment described above, second roller pairs are provided corresponding to the line print heads of each color in the printing unit 4, but other configurations may be made. For example, as shown in FIG. 8, an arrangement may be made wherein there is just one second roller pair (conveying roller 103 and pinch roller 104) downstream of the print head 14*g* which is farthest downstream. The single platen 112 is shared among the multiple print heads 14*a* through 14*g*. Alternatively, the multiple print heads may be divided into multiple groups, with a second roller pair being provided to each group. With these configurations as well, the relation of conveying force (Expression 1) and conveying speed (Expression 2) described above is to be satisfied.

Figure 9:
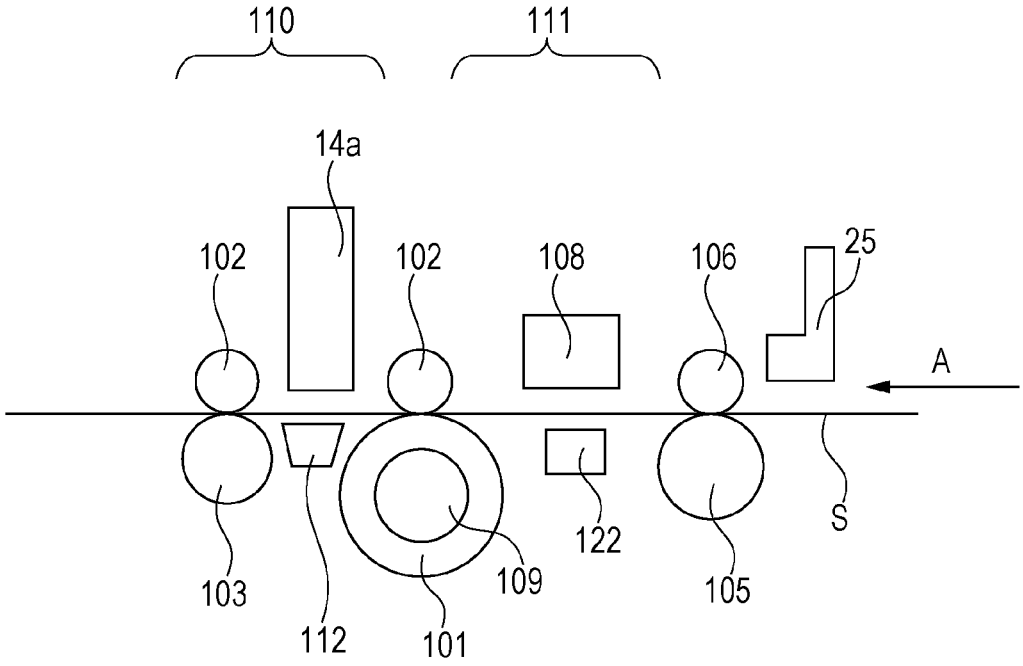
FIG. 9 is a diagram illustrating an example of a serial print head.
Figure 10:
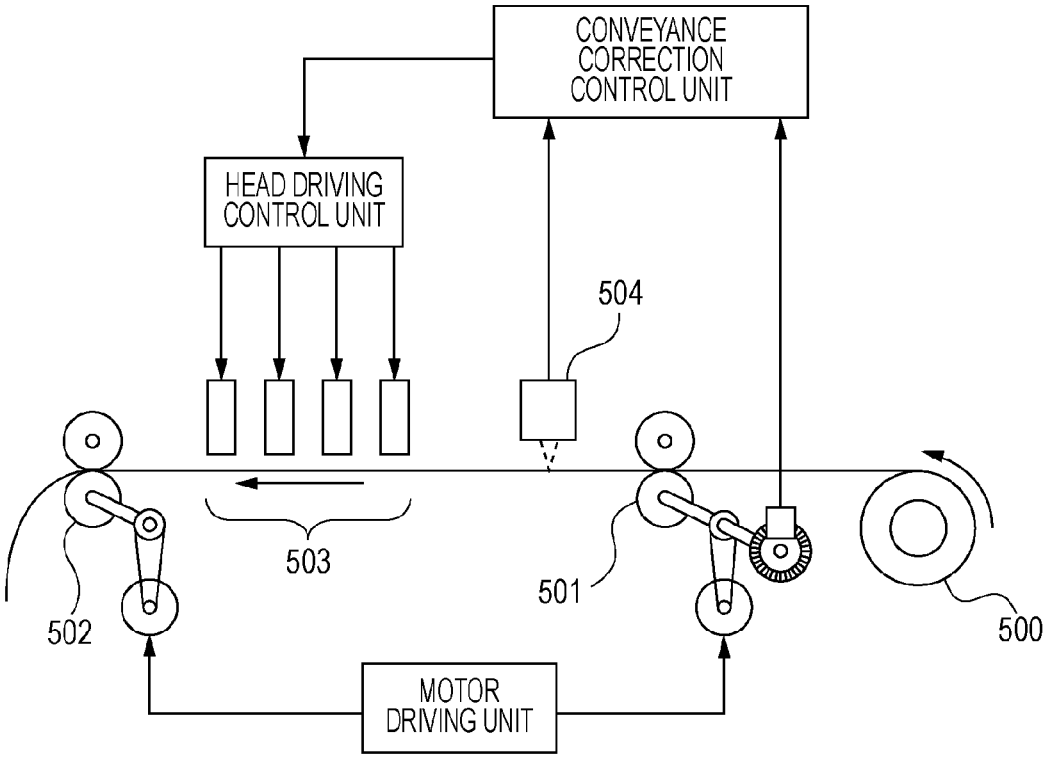
FIG. 10 is a schematic diagram of a conventional example.

Also, the print head 14 may be a serial print head instead of a line print head, as shown in FIG. 9. A serial print head 14*a* is mounted on a carriage and reciprocally travels in the direction orthogonal to the sheet conveying direction A (near/far direction in FIG. 9). Multiple nozzle rows corresponding to multiple colors are formed on a single print head 14*a*. A single second roller pair (conveying roller 103 and pinch roller 104) are provided downstream of the print head 14*a*. In the case of this configuration as well, the relation of conveying force (Expression 1) and conveying speed (Expression 2) described above is to be satisfied.

The print device of the embodiment described above has a first roller pair nipping the sheet at the upstream side of the print head, second roller pairs nipping the sheet at the downstream side of the print head, and a third roller pair nipping the sheet at the upstream side of the first roller pair. A direct sensor is positioned to measure the sheet face at a position between the nip position of the first roller pair and the nip position of the third roller pair. This configuration yields the following advantages.

(1) The distance between the first roller pair and the print head can be reduced. Accordingly, the probability of the leading edge of the sheet undulating between the first roller pair leading the sheet in and the print head, resulting the leading edge of the sheet coming into contact with the nozzles of the print head farthest upstream, can be reduced.

(2) The distance between the direct sensor and the print head is great, so there is sufficient time for performing calculations at the direct sensor and controlling the ink discharge timing, while the sheet passes from the measurement position of the direct sensor and reaches the print head farthest upstream. In other words, the sheet conveying speed can be increased and printing speed improved.

(3) The distance between the direct sensor and the print head is great, and also the first roller pair is situated therein, so cockling occurring when the sheet absorbs ink immediately after printing can be prevented from influencing the measurement position.

Due to the above (1) through (3), high-speed conveying of sheets and precise measurement of the direct sensor are both realized at a high level, i.e., printing throughput and printing quality are realized at a high level. Additionally, the following advantages can be had.

(4) The distance between the direct sensor 108 and print head 14 is great, and also the first roller pair is situated therebetween as a shielding object thereby alleviating adhesions of scattered ink mist generated at the print head when discharging ink to the direct sensor. Accordingly, the direct sensor can maintain high measurement precision even when operating for long periods of time, and high printing quality can be maintained.

(5) Gas generated at the humidifier 20 flows through the gap between the print head and the sheet, upstream to downstream. There is little chance that the ink mist will scatter to the direct sensor side against this airflow, thereby further alleviating adhesion of ink mist to the direct sensor.

(6) The direct sensors 108 and mark reader 122 are disposed facing each other across the sheet, so two types of information (moving information and face image position information) can be obtained form the sheet with a compact device configuration effectively utilizing the measurement position 111. A printing apparatus where duplex printing can be performed with a compact configuration can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042339 filed Feb. 26, 2010, which is hereby incorporated by reference herein in its entirety.

What is claimed is:

1. An apparatus comprising:

a sheet feeding unit configured to feed a sheet that is a continuous sheet;

a reverse unit configured to reverse the sheet for duplex printing, wherein, in the duplex printing, a printing unit performs printing a plurality of images on a first surface of the sheet fed from the sheet feeding unit, the printed sheet is reversed by the reverse unit to feed the reversed sheet to the printing unit again, and the printing unit performs printing a plurality of images on a second surface, which is a back of the first surface, of the sheet fed from the reverse unit;

the printing unit, wherein the printing unit is configured to print on the sheet and convey the sheet as a conveyed sheet, wherein the printing unit includes:

a print head, a first roller pair configured to nip the sheet at an upstream side of the print head to convey the sheet, a second roller pair configured to nip the sheet at a downstream side of the print head to convey the sheet, a third roller pair configured to nip the sheet at an upstream side of the first roller pair to convey the sheet, a direct sensor configured to measure a surface of the conveyed sheet at a measurement position between a nip position of the first roller pair and a nip position of the third roller pair to obtain information relating to a movement speed of the conveyed sheet, and a mark reader configured to read marks, formed on a first surface of the sheet fed from the sheet feeding unit by the print head with a plurality of images, at a reading position between the nip position of the first roller pair and the nip position of the third roller pair when printing on a second surface of the sheet fed from the reverse unit;

a humidifying unit having a duct leading to a discharge opening located at an upstream side of the nip position of the third roller pair to introduce a humidifying gas from the humidifying unit in a way that causes the introduced humidifying gas to flow through around the measuring position of the direct sensor, then flow through a gap between the print head and the sheet; and a control unit configured to control to correct at least one of driving control of the print head and conveying control of the sheet based on the information obtained by the direct sensor, and to adjust print positions of each image on the second surface of the continuous sheet to each image on the first surface of the continuous sheet based on read timings by the mark reader.

2. The apparatus according to claim 1, wherein the printing unit comprises a plurality of inkjet line print heads arrayed in a conveying direction of the sheet, with the control unit controlling a driving timing of each inkjet line print head of the plurality of inkjet line print heads based on the measurement of the direct sensor.

3. The apparatus according to claim 2, wherein a plurality of second roller pairs is provided, corresponding to each inkjet line print head of the plurality of inkjet line print heads.

4. The apparatus according to claim 1, wherein the continuous sheet is longer than a length of repetition printing units in a conveying direction of the sheet, the apparatus further comprising a cutter unit configured to cut the continuous sheet on which the plurality of images have been printed into a plurality of cut sheets.

5. The apparatus according to claim 1, wherein the reverse unit includes a winding rotary member, and wherein the printed sheet on the first surface is temporarily wound around the winding rotary member as a wound sheet, and subsequently, the winding rotary member is configured to rotate in reverse to feed the wound sheet to the printing unit.

6. The apparatus according to claim 1, wherein the direct sensor is disposed on a front face side of the sheet, and the mark reader is disposed on a back face side of the sheet that is opposite the front face side of the sheet.

7. The apparatus according to claim 1, wherein the direct sensor and the mark reader are both disposed on a back face side of the continuous sheet so that the continuous sheet passes between the print head facing a printing side of the continuous sheet and the direct sensor and the mark reader facing the back face side to provide blockage of ink mist from the print head to the direct sensor and the mark reader and prevent degradation in detection performance by the direct sensor and the mark reader.

8. The apparatus according to claim 7, wherein the direct sensor includes at least two direct sensors provided in a sheet width direction.

9. The apparatus according to claim 1, wherein the direct sensor is a laser Doppler sensor.

10. The apparatus according to claim 1, wherein the first roller pair, the second roller pair, and the third roller pair are each provided with driving force, wherein conveying force for conveying the sheet satisfies a conveying force relationship: the first roller pair>the second roller pair>the third roller pair whereby the first roller pair, residing between the second roller pair and the third roller pair, has an influence on a sheet conveyance accuracy that is greater than sheet conveyance accuracy influence provided by either the second roller pair and the third roller pair to improve an overall sheet conveyance accuracy, and wherein sheet conveyance speed satisfies: the second roller pair>the first roller pair>the third roller pair such that a downstream sheet conveyance speed exceeds an upstream sheet conveyance speed which, along with the conveying force relationship, work to reduce slippage at the roller at which the first acquisition unit acquires rotation information and to obtain more accurate information regarding conveying error caused by defect related to the roller.

11. The apparatus according to claim 10, wherein the third roller pair is provided with a torque limiter.

12. The apparatus according to claim 1, wherein a roller at a print head side constituting the first roller pair is divided into multiple small roller portions in a width direction of the sheet such that a part of the humidifying gas passes between and around adjacent small roller portions and reaches the gap between the print head and the sheet.

13. The apparatus according to claim 1, wherein a nip of the third roller pair can be disengaged, and a nipped state of the third roller pair is maintained at least while performing measurement with the direct sensor.

14. The apparatus according to claim 1, wherein the direct sensor is a reading roller, and wherein a rotary encoder is provided on the reading roller.

15. The apparatus according to claim 1, wherein the print head is multiple print heads, wherein the second roller pair is no more than one second roller pair, and wherein the no more than one second roller pair is positioned at a downstream side of the multiple print heads to convey the sheet.

16. The apparatus according to claim 1, wherein the humidifying unit receives the humidifying gas through a duct connected to a drying unit configured to receive the sheet.

* * * * *